United States Patent [19]

Vachhani et al.

[11] Patent Number: 4,702,544

[45] Date of Patent: Oct. 27, 1987

[54] ELECTRICAL CONNECTOR

[75] Inventors: Vasantrai A. Vachhani, Eden Prairie; Gilbert D. Bodimer, Burnsville, both of Minn.

[73] Assignee: Magnetic Controls Company, Minneapolis, Minn.

[21] Appl. No.: 492,215

[22] Filed: May 6, 1983

[51] Int. Cl.[4] ..... H01R 4/24

[52] U.S. Cl. ..... 439/395; 439/400

[58] Field of Search ..... 339/97 R, 97 P, 98, 339/99 R, 258 RR, 258 R, 277, 95 R

[56] References Cited

U.S. PATENT DOCUMENTS

| | | | |
|---|---|---|---|
| 3,521,221 | 7/1970 | Lenaerts et al. | 339/97 P |
| 3,636,500 | 1/1972 | Sedlacek | 339/97 R |
| 3,897,993 | 8/1975 | Fleischhacker | 339/99 R |
| 4,118,091 | 10/1978 | Frisby | 339/97 P |
| 4,283,105 | 8/1981 | Ferrill et al. | 339/97 R |
| 4,343,529 | 8/1982 | Reavis, Jr. et al. | 339/97 R |
| 4,431,247 | 2/1984 | Abdullah et al. | 339/97 P |

FOREIGN PATENT DOCUMENTS

| | | | |
|---|---|---|---|
| 2438178 | 3/1975 | Fed. Rep. of Germany | 339/97 R |
| 2258715 | 1/1974 | France . | |
| 2419594 | 10/1979 | France . | |
| 1434003 | 4/1976 | United Kingdom | 339/98 |

*Primary Examiner*—Gil Weidenfeld
*Assistant Examiner*—Thomas M. Kline
*Attorney, Agent, or Firm*—Dorsey & Whitney

[57] ABSTRACT

An electrical connector of the split cylinder type for terminating or connecting an electrical wire comprising an elongated tubular sleeve section, an elongated wire receiving slot, a flared entryway leading into the wire receiving slot and a wire retaining means for temporarily retaining the electrical wire within the flared entryway in position for termination or connection within the wire receiving slot.

7 Claims, 16 Drawing Figures

ELECTRICAL CONNECTOR

BACKGROUND OF THE INVENTION

The present invention relates generally to a slotted electrical connector in which one or more wires are electrically terminated or connected and more particularly to an improvement in a split cylinder type of connector having an elongated tubular sleeve and a wire receiving slot or seam for receiving said wire and retaining the same in electrical connection with the connector.

There are many split cylinder type connectors which presently exist in the prior art. Three such connectors are described in U.S. Pat. Nos. 4,141,618, 4,283,105 and 3,845,455. A split cylinder type connector makes electrical engagement with the terminated or connected wire by insulation displacement rather than by conventional soldering or stripping of insulation. A typical split cylinder connector includes an elongated, tubular element having a longitudinal wire receiving slot or seam extending throughout a substantial portion of the tubular member. Although the tubular member of most split cylinder connectors in the prior art are cylindrically shaped and have a generally circular cross-section, they can have various other shapes as illustrated by the generally rectangular cross-sectional configuration in U.S. Pat. No. 3,845,455. The split cylinder connector is used to terminate or to electrically connect various electrical leads or terminals with one another. Such connectors are commonly used in the communications or data transmission or processing area although they can clearly be used for other applications as well.

In the split cylinder connectors of the prior art, a wire is first laid over the top or open end of the tubular member. A wire insertion tool is then used to force the wire downwardly into the elongated tubular member and within the wire receiving slot so that the opposing edges of the slot pierce the insulation, thus making electrical contact with the conductor portion of the wire. Means are also normally provided in the connector for severing the free end of the wire. Although the split cylinders presently existing in the art are satisfactory for many applications, particularly those where individual wires are terminated or connected via the aforementioned insertion tool prior to termination or connection of the next wire, they have serious drawbacks when a plurality of such connectors are arranged in an array and it is desired to first align all of the wires and then to terminate the same, one after the other, with the insertion tool. Although it would be much more efficient to terminate a plurality of wires in this manner, the present split cylinder connectors do not permit this type of procedure since each of the wires must be laid over the open end of the cylinder, retained in that position manually and then terminated prior to proceeding with the next wire.

Accordingly, there is a need in the art for a split cylinder connector which includes means for retaining a wire in an aligned or ready state for termination so that a plurality of such wires can first be aligned and then terminated consecutively.

SUMMARY OF THE PRESENT INVENTION

The present invention relates to an improved connector of the split cylinder type which overcomes the above-mentioned deficiencies in the prior art by including means for retaining a wire in a ready position for termination while other wires are being similarly aligned with respect to other connectors. This permits a more efficient termination of wires into an array of connectors since the wires can all first be aligned and then they can each be consecutively terminated by insertion into the wire retaining seam by an appropriate insertion tool.

In contrast to the prior art, the structure of the connector of the present invention includes a wire retaining means for temporarily retaining the wire within the flared entryway to the wire retaining slot in position for termination. More specifically, this means includes a wire retaining hook or groove integrally formed within the body of the connector so that the wire to be terminated can be retained in an aligned wire insertion position while other wires are being similarly aligned.

The improved connector of the present invention also includes means associated with the elongated wire retaining slot or seam for more securely retaining the terminating wire or wires within the seam, thus substantially reducing the possibility that the wires will be inadvertently pulled out of or disconnected from engagement with the connector. One embodiment of such means includes the provision of a short transverse slot in the body of the tubular element at a position above the position at which the wires are normally retained. The provision of such a slot permits the portion of the slot or seam above the terminated wire to be narrower. Thus, when a pulling force is exerted on the wire, the wire engages the sharp edge of the slot and narrow seam above it, thus making it much more difficult to pull the wire from the seam. A second embodiment of this means includes providing a plurality of small notches within the elongated wire retaining slot just above the position at which the conductors are to be retained. As the wire is pulled upwardly in a direction which would pull it out of the connector, the sharp corners of the notches engage the insulation, thereby resisting removal of the wire from the slot.

Accordingly, it is an object of the present invention to provide an improved connector.

Another object of the present invention is to provide an improved split cylinder connector with means for retaining the wire to be terminated or connected in position for insertion, thus permitting a plurality of wires to be aligned for insertion and then consecutively terminated.

A further object of the present invention is to provide a connector of the split cylinder type with a wire groove or hook for temporarily retaining the wire to be inserted in an aligned position for insertion.

Another object of the present invention is to provide an improved slit cylinder type connector having an improved means for retaining the terminated wire within the wire retaining slot.

These and other objects of the present invention will become apparent with reference to the drawings, the description of the preferred embodiment and the appended claims.

DESCRIPTION OF THE PREFERRED EMBODIMENT

Figure 1:
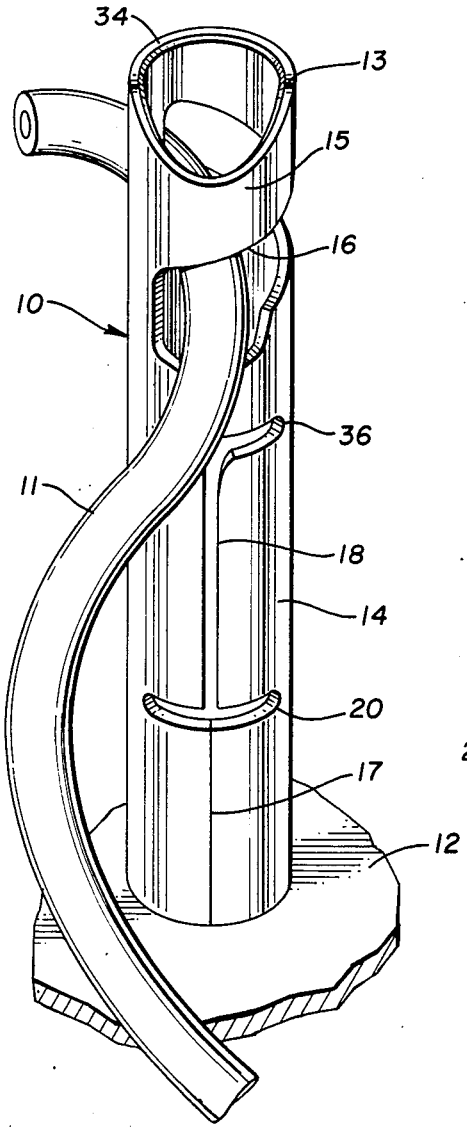
FIG. 1 is a pictorial view of the split cylinder connector of the present invention with the wire to be terminated being retained in a wire insertion position by the preferred embodiment of a wire retaining means.

The preferred embodiment of the connector 10 of the present invention is illustrated generally in FIG. 1 and more specifically in FIGS. 2–7. This connector 10 is of the split cylinder type and includes an elongated tubular body or section 14, an elongated wire receiving slot or seam 18 and a means for retaining a wire 11 in position for termination near the upper end of the cylinder 10. In the preferred embodiment the tubular section 14 is cylindrical with a generally circular cross-section although it is contemplated that such section 14 could have various other configurations as well. The tubular section 14 is comprised of a side wall having a generally hollow interior. The wire receiving slot or seam 18 is defined by a pair of opposing wire gripping edges in the side wall of the section 14 and extends generally parallel to the longitudinal axis of the tubular section 14. A lower seam 17 is disposed below a cross slot 20 to assist in properly spacing the wire gripping edges of the slot 18. The connector 10 is adapted for connection to a base 12 in accordance with any means conventional in the art.

It is contemplated that the means for temporarily retaining the wire 11 in position for termination could comprise various structures; however, in the preferred embodiment of FIGS. 1–7 this means comprises a wire holding groove 16 defined within the upper cylinder section 15. As best illustrated in FIG. 1, the wire 11 to be terminated is hooked within the groove 16 and bent slightly around the back of the cylinder 10 so that the wire 11 is retained in this position while other similar wires are being connected with their respective connectors. Following the alignment of an entire array of wires with the connectors desired, the installer is able to terminate all of the wires consecutively by using a wire insertion tool. The ability of the connector of the present invention to facilitate this type of termination provides improved efficiency in the termination of an entire array of the connectors which might, for example, be disposed on the surface of a panel or some other means.

Figure 2:
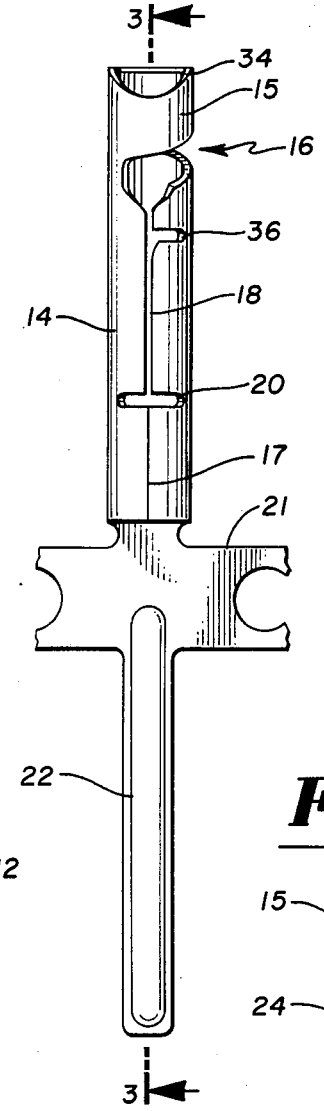
FIG. 2 is an elevational front view of the preferred embodiment of the split cylinder connector of the present invention.
Figure 3:
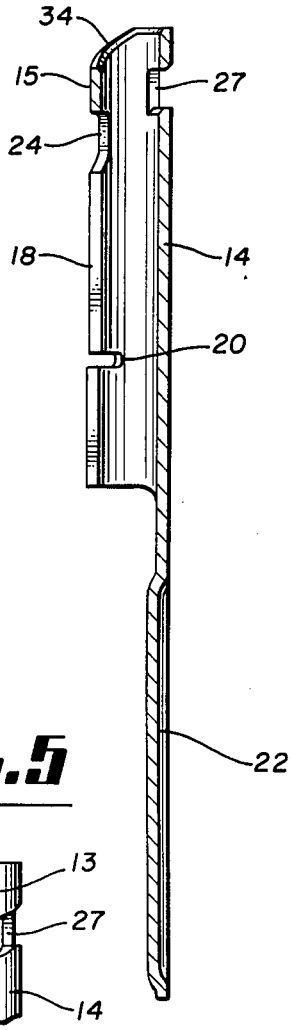
FIG. 3 is a sectional view of the split cylinder connector of the present invention as viewed along section line 3—3 of FIG. 2.

As illustrated in FIGS. 2 and 3, the lower end of the tubular portion 14 is connected with a metal strip or commoning bar 21 which is integrally formed with the tubular portion 14 during assembly. The lower end of the connector 10 is provided with a conventional wire wrap end or post 22. It is contemplated, however, that this lower end can be eliminated completely or can comprise various other types of connector configurations including a connector configuration of the split cylinder type.

Figure 5:
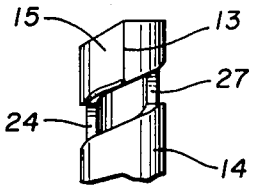
FIG. 5 is an elevational side view of the upper portion of the split cylinder connector of the present invention.
Figure 4:
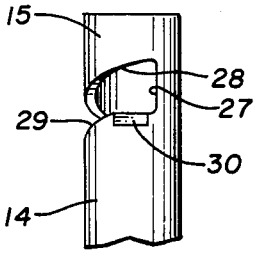
FIG. 4 is an elevational rear view of the top portion of the split cylinder connector illustrated in FIG. 2.

With general reference to FIGS. 2–7, it can be seen that the tubular section 14 includes a flared entryway defined by the upper, flared extensions of the opposing edges of the wire receiving slot 18. In the preferred embodiment, this flared entryway is defined by the lead-in edges 25 and 26 which diverge in opposite directions from the slot 18 to form a generally V-shaped configuration. The purpose of the flared entryway is to guide the wire 11 (FIG. 1) into the wire receving slot 18. The wire retaining groove 16 extends from a point defined by the edge 24 on one side of the wire receiving slot 18 around one side of the connector 10 to a point defined by the edge 27 (FIGS. 3–5 and 7). It should be noted that the edge 24 which is joined with and extends from the lead-in edge 25 should be close enough to the slot 18 so that when the wire 11 is initially positioned for termination, it is retained in a position reasonably aligned with the slot 18. Thus, when the wire 11 is terminated, it will be inserted within the slot 18 rather than severed as a result of engagement with the lead-in edge 25. The wire retaining groove 16 is defined along its top and bottom by an upper edge 28 and a bottom edge 29, respectively. As illustrated in FIGS. 2, 4 and 5, the upper edge 28 extends from the side edge 24 to the side edge 27 and is defined by the edge portions **28*a* and 28*b*, whereas the lower edge 29 extends from the upper end of the lead-in edge 26 to the cut-off edge 30**.

In the preferred embodiment, the wire retaining groove 16 is angled with respect to the longitudinal axis of the connector 10. The purpose of this angle is to facilitate easy wire entry if the wire is coming in at an angle to the axis of the connector. In such case, the angle of the groove 16 is aligned approximately with the angle of the incoming wire. It is contemplated that the wire groove 16 could be disposed at any particular angle and could even be generally perpendicular to the elongated axis of the connector if the incoming wire was generally horizontal. Preferably, the angle of the wire groove 16 should be generally parallel to the contemplated direction of the incoming wire.

Figure 4A:
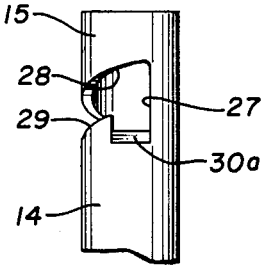
FIG. 4*a* is an elevational rear view, similar to FIG. 4, showing an alternate embodiment of the wire cut-off edge.
Figure 7:
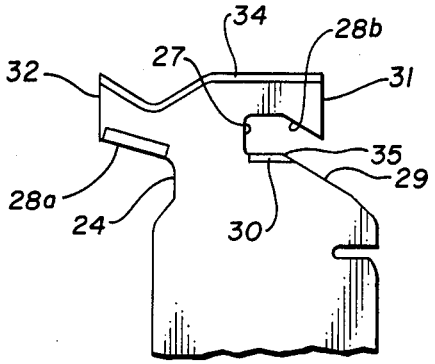
FIG. 7 is an elevational view of the upper portion of the split cylinder connector illustrated in FIG. 2 as it is punched out of the original metal stock and prior to being formed into a cylindrical configuration.
Figure 8:
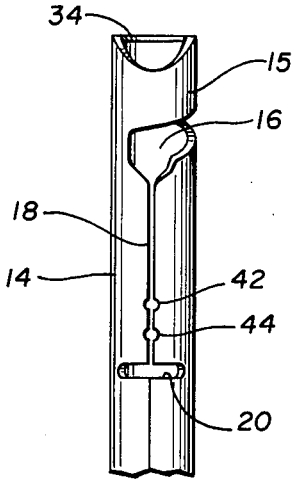
FIG. 8 is an elevational front view of the split cylinder connector of the present invention showing an alternate embodiment of a means for retaining the wire in the wire receiving slot.

As illustrated best in FIGS. 4 and 7, a rearward portion of the wire groove 16 is provided with a cut-off edge 30. In the preferred embodiment, this wire cut-off edge 30 is coined so as to provide a slightly sharpened edge to facilitate easy cut-off. In the preferred embodiment, the transition point 35 between the lower edge 29 of the wire groove 16 and the cut-off edge 30 is provided with a relatively sharp point so that as the wire is pulled into the groove 16, the point 35 nicks or cuts the insulation. This further aids retention of the wire within the groove 16. As noted in the preferred embodiment illustrated in FIGS. 4 and 7, the wire cut-off edge 30 extends continuously from the edge 29 to the edge 27. An alternate embodiment for the wire cut-off edge is illustrated in FIG. 4*a* which shows the wire cut-off edge 30*a* with a stepped down configuration. It is believed that this stepped down feature improves the wire retention ability of the wire groove 16.

Figure 6:
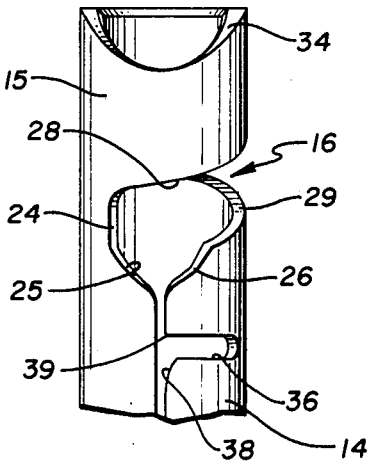
FIG. 6 is an enlarged elevational view of the upper portion of the split cylinder connector illustrated in FIG. 2.

As shown best in FIGS. 6 and 7, the wire groove 16 includes an enlarged entry area to permit easy entry of the wire 11 (FIG. 1). This enlarged entry area is a result of the area defined by the flared entryway to the slot 18 as well as the fact that the front portion 28*a* of the top edge 28 is angled upwardly relative to the rearward portion 28*b*. This is shown best in FIG. 7. This construction permits the wire 11 (FIG. 1) to be more easily guided into the wire groove 16 and into the V-shaped entryway formed by the surfaces 25 and 26. It should be noted that the portion 28*a* can also be coined as illustrated in FIG. 7 to permit the wire to be more easily guided into the groove 16.

As shown best in FIG. 5, the upper cylindrical portion 15 of the connector includes a pair of sections which are joined together along the seam 13. In the preferred embodiment the seam 13 is disposed along a side edge of the cylinder 10 approximately 90° from the elongated slot 18. The top edge 34 of the upper portion 15 is tapered throughout approximately one-half of its perimeter in order to improve alignment of the wire insertion tool (not shown). In the preferred embodiment, the taper is disposed forwardly toward the slot 18.

The split cylinder connector of the present invention also includes means for assisting retention of the terminated wires within the wire receiving slot 18. As illustrated in FIGS. 1, 2 and 6, this means includes a wire retention cross slot 36 positioned on one side of the wire receiving slot 18 and near the top portion of the slot 18. The cross slot 36 includes a smooth radius 38 on its lower edge (FIG. 6) and a relatively sharp point 39 on its upper edge. Thus, the wire which is being terminated is allowed to easily pass the cross slot 36 because of the radius on the corner 38. However, the relatively sharp point 39 will dig into the insulation of the wire and restrict its removal; thus, substantially reducing any inadvertent removal of the terminated wire from the connector. It should be noted that a slot similar to the slot 36 can be placed on both sides of the slot 18.

Figure 9:
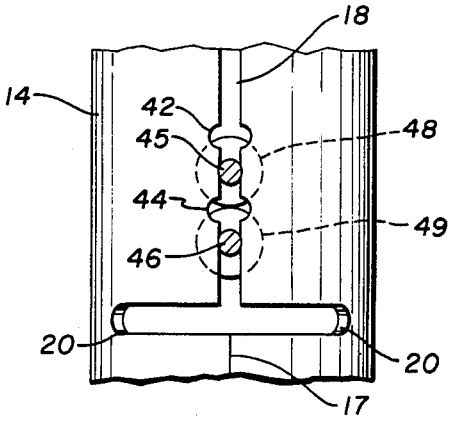
FIG. 9 is an enlarged view of a portion of the alternate embodiment of FIG. 8 showing a pair of wires retained in the wire receiving slot.

FIGS. 8, 9, 14 and 15 illustrate alternate embodiments of a means for assisting retention of the terminated wire 46 within the wire receiving slot 18. The alternate means illustrated in FIG. 8 and 9 includes a plurality of notches 42, 44 on the inner edges of the wire receiving slot 18. As illustrated, each of the notches 42, 44 has an oppositely disposed, corresponding notch on the opposite side of the slot 18. When wires 45 and 46 are terminated as illustrated in FIG. 9, the insulation 48 and 49 and wires 45 and 46 will tend to catch on the pointed edges of the notches, thus making it more difficult to pull the wires from the connector. In the preferred embodiment, the notches 42 and 44 are positioned slightly above the part of the slot 18 in which the terminated wires are intended to be positioned.

Figure 14:
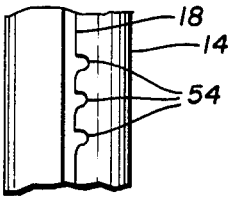
FIG. 14 is an elevational front view of a portion of the split cylinder connection of the present invention showing a further embodiment of a plurality of wire retaining notches.
Figure 15:
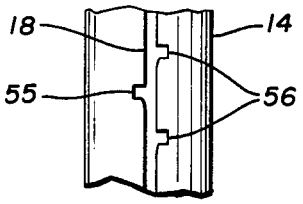
FIG. 15 is an elevational front view, similar to FIG. 14, showing a further embodiment of a plurality of wire retaining notches.

The embodiment illustrated in FIG. 14 shows a plurality of notches 54 disposed on one side of the slot 18, while the embodiment of FIG. 15 shows a plurality of notches 55 and 56 on opposite sides of the slot 18, but staggered so from one another. It should be noted that the notches 54, 55 and 56 in the structures of FIGS. 14 and 15 are rounded at their bottom edges where they join with the slot 18. This facilitates easy passage of the wire into an inserted position, while still providing added retention to reduce the chances of inadvertent removal.

The preferred embodiment of the connector 10 also includes a pair of oppositely disposed cross slots 20 at the lower end of the tubular portion 14. The purpose of these cross slots 20 is to reduce the spring forces which act on the terminated wire from the portion of the tubular section below the cross slots 20. Thus, the cross slots 20 will tend to isolate and limit the gripping forces acting upon the wire 11 (FIG. 1) to those above the cross slots 20 and below the lead-in edges 25 and 26 (FIG. 6). The cross slots 20 also allow control for sizing of the wire slot 18 by virtue of the seam 17 disposed below the cross slots 20.

Figure 12:
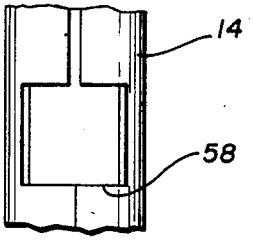
FIG. 12 is an elevational front view of a portion of the split cylinder connector of the present invention showing a means for cleaning wire pieces from the slot and removing the bottom wire of a two wire combination.
Figure 13:
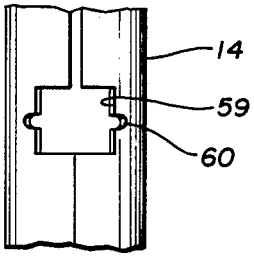
FIG. 13 is an elevational front view, similar to FIG. 12, showing an alternate embodiment of a means for cleaning wire pieces from the slot and removing the bottom wire of a two wire combination.

FIGS. 12 and 13 illustrate alternate embodiments of cross slots. In FIG. 12, the cross slot 58 is shown to be significantly larger than the cross slots 20 shown in the preferred embodiment. This larger size slot 58 provides two functions. First, it permits the removal of wire scrap and pieces from the slot 18 which become lodged during extensive use. Secondly, it permits removal of the bottom wire in a two wire combination without removing the top wire. To facilitate these functions, the cross slot 58 must have dimensions sufficiently large to allow an inserted wire to be removed through it. Thus, the smallest dimension should be at least as large as the diameter of the terminated wire.

The embodiment of FIG. 13 shows a cross slot 59 similar to the cross slot 58 except that it is smaller and includes a further cross slot 60. The cross slot 60 is used to further reduce the transfer of spring force from the section below the cross slot to the wire gripping slot 18.

Figure 10:
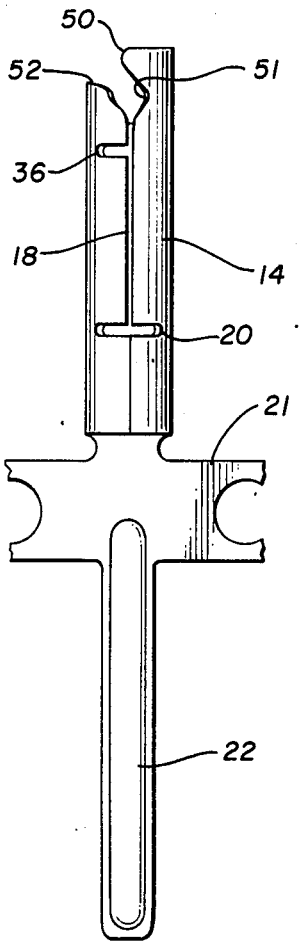
FIG. 10 is an elevational front view of an alternate embodiment of the split cylinder connector of the present invention.
Figure 11:
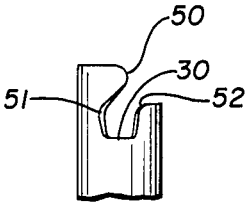
FIG. 11 is an elevational rear view of the top portion of the split cylinder connector illustrated in FIG. 10

FIG. 10 illustrates an alternate embodiment of the split cylinder connector of the present invention. In FIG. 10 the means for temporarily retaining the wire to be terminated in an insertion position does not extend into a tubular section as shown in FIGS. 1–6, but rather terminates so as to merely form a hook portion around which the wire can be bent. It should be noted that this hook portion includes a recessed portion 51 which extends to one side of the wire receiving or gripping slot 18 and a second portion 50 which extends outwardly to a point past an extension of the wire gripping slot 18. FIG. 11 illustrates an elevational rear view of the upper end of the alternate embodiment in FIG. 10. As shown, the cut-off edge 30 is recessed with respect to the recessed side wall portion 52. This area between the elements 51, 52 and 30 forms the area in which the wire is retained.

In operation, it is contemplated that a relatively large number of the connectors of the present invention will be arranged in an array with a plurality of wires near by and intended for termination with respect to these connectors. Each of the plurality of wires will then be manually aligned with respect to its particular connector by inserting the wire 11 into the wire groove 16 (as shown in FIG. 1) or around the wire hook as defined by the elements 50, 51 and 52 (FIGS. 10 and 11). The wire will remain in this position, without manual assistance, until it is terminated. After a desired number of the wires are aligned in this manner, the installer uses an appropriate wire insertion tool to simply terminate the aligned wires consecutively. It has been shown that this results in substantially greater efficiency when installing wires in this fashion.

Although the description of the preferred embodiment has been quite specific, it is contemplated that various changes could be made without deviating from the spirit of the present invention. Accordingly, it is intended that the scope of the present invention be dictated by the appended claims rather than by the description of the preferred embodiment.

We claim:

1. An electrical connector for terminating or connecting an electrical wire comprising:

an elongated tubular sleeve section having a side wall and a longitudinal axis;

an elongated wire receiving slot defined by a pair of opposing wire gripping edges in said side wall and extending generally parallel to said longitudinal axis;

a flared entryway defined by a pair of flared edges comprising an extension of said pair of opposing wire gripping edges; and wire retaining means for temporarily retaining the electrical wire within said flared entryway in position for termination or connection within said wire receiving slot, said wire retaining means including a wire retention groove formed in said side wall and disposed immediately above said flared entryway and being spaced below the upper end of said sleeve section, said wire retention groove having upper and lower edges which extend from said flared edges, respectively, and a side opening in said side wall between said upper and lower edges for receiving the electrical wire, said upper and lower edges, and thus said wire retention groove, sloping upwardly from said wire receiving slot relative to the longitudinal axis of said sleeve section.

2. The electrical connector of claim 1 including a tubular portion disposed above said wire retention groove.

3. The electrical connector of claim 2 wherein the upper edge of said tubular portion is tapered.

4. The electrical connector of claim 2 including a wire cut-off edge at a position diametrically opposite said wire receiving slot.

5. The electrical connector of claim 4 wherein said wire retention groove slopes upwardly relative to the longitudinal axis of said sleeve section from said wire receiving slot toward said wire cut-off edge.

6. The electrical connector of claim 1 including means for reducing the inadvertent removal of the electrical wire from said wire receiving slot including a cross slot disposed on one side of said wire receiving slot and at right angles thereto.

7. The electrical connector of claim 6 wherein the lower edge of said cross slot joins with said wire receiving slot through a rounded corner and the upper edge of said cross slot joins with said wire receiving slot at a sharp corner.

* * * * *